US006299384B1

(12) United States Patent
Glasscock et al.

(10) Patent No.: US 6,299,384 B1
(45) **Date of Patent: *Oct. 9, 2001**

(54) EARTHQUAKE-COMPLIANT JACKET

(75) Inventors: M. Sidney Glasscock, Houston, TX (US); Josh E. Jones, Cobham (GB); Kenneth M. Steele, Bellaire, TX (US)

(73) Assignee: ExxonMobil Upstream Research Co., Houston, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/089,460

(22) Filed: Jun. 2, 1998

Related U.S. Application Data

(60) Provisional application No. 60/049,916, filed on Jun. 18, 1997.

(51) Int. Cl.[7] ..... E02B 17/00

(52) U.S. Cl. ..... 405/227; 405/224; 114/264

(58) Field of Search ..... 405/227, 195.1, 405/203, 204, 211, 224; 114/264, 265; 52/167.1, 167.4

(56) References Cited

U.S. PATENT DOCUMENTS

| | | | | |
|---|---|---|---|---|
| 3,585,801 | * | 6/1971 | Koehler | 405/227 |
| 3,895,471 | * | 7/1975 | Kolb | 405/227 X |
| 3,987,636 | * | 10/1976 | Hruska et al. | 405/227 X |
| 4,014,176 | * | 3/1977 | Weidler | 405/227 X |
| 4,045,968 | | 9/1977 | Gerwick, Jr. . | |
| 4,102,143 | * | 7/1978 | Phares et al. | 405/227 |
| 4,117,690 | | 10/1978 | Besse | 405/227 |
| 4,576,523 | * | 3/1986 | Smetak | 405/227 |
| 5,480,265 | | 1/1996 | Marshall et al. | 405/224 |
| 5,527,136 | | 6/1996 | Bayazitoglu et al. | 405/227 |

OTHER PUBLICATIONS

Y. T. Huang, "Modular Space Framed Earthquake Resistant Structures", Seventh International Conference on Offshore Mechanics and Arctic Engineering, Houston, TX, Feb. 7–12, 1988, pp. 423–427.

Kenji Kawano, K. Venkataramana and Takahiro Komasa, "Seismic Response Reductions of Offshore Platform", Fifth International Offshore and Polar Engineering Conference, The Hague, The Netherlands, Jun. 11–16, 1995, pp. 443–449.

* cited by examiner

*Primary Examiner*—David Bagnell
*Assistant Examiner*—Sunil Singh
(74) *Attorney, Agent, or Firm*—Kelly A. Morgan

(57) ABSTRACT

An earthquake-compliant offshore platform for use in regions of strong earthquakes is disclosed in which the natural vibrational period of the jacket structure is preferably in the range of about 4 seconds to about 8 seconds, which is between the primary excitation period of earthquake energy and the primary storm wave period. The earthquake-compliant jacket structure is lighter than a conventional steel battered jacket for the same location and conditions and has a constant cross-section. The vibrational period of the earthquake compliant platform can be tuned by altering structural stiffness or mass.

18 Claims, 3 Drawing Sheets

EARTHQUAKE-COMPLIANT JACKET

REFERENCE TO RELATED APPLICATION

This application claims the benefit of U. S. Provisional Patent Application No. 60/049,916 filed Jun. 18, 1997.

FIELD OF THE INVENTION

This invention relates generally to the field of offshore structures. More specifically, the present invention is an earthquake-compliant offshore platform jacket structure for use in regions of strong seismic activity.

BACKGROUND OF THE INVENTION

Offshore oil and gas production is often conducted from platforns secured to the ocean bottom. One important design constraint for such platforms is that there be no substantial dynamic amplification of the platform's response to storms (a combination of wind, waves, and currents). Typically, most of a storm's wave energy falls within the 9 to 16 second period range. Consequently, to minimize the impact of storms on offshore structures, designers have engineered two types of structures, Steel Piled Jackets (SPJs) and Compliant Towers (CTs). These concepts differ mainly in the way they avoid wave energy. The SPJ, which is a stiff battered (i.e., having sloped sides) structure, uses its 2 to 4 second natural period to remain substantially below the period of storm wave energy. On the other hand, the CT, a flexible unbattered structure, uses its 20–30 second natural period to stay substantially above the storm wave energy. Generally, SPJs are economically viable structures in water depths less than approximately 1,000 feet, whereas CTs are economically viable structures in water depths greater than approximately 1,000 feet.

In addition to storm loads, some platforms may also be subjected to earthquakes. As can be seen from FIG. 1, most earthquake (seismic) energy falls within the 0 to 2 second range. A conventional SPJ will likely have a natural period of 2 to 4 seconds. While this period is well distanced from the typical 9 to 16 second wave period of storm energy, it is close enough to the 0 to 2 second excitation period of earthquake energy so as to be heavily influenced. Typically, a SPJ, because its low natural period is close to the earthquake energy, will have a large response in a seismic event, and thus most members will be designed primarily by the earthquake loads. In areas where earthquake loads are strong, the resulting structure tends to be a relatively heavy, inefficient SPJ. A CT, on the other hand, would have little dynamic response during an earthquake, but would be a very expensive concept for developing compliancy in the water depths where an SPJ is typically the preferred alternative.

Therefore, it would be desirable to have a more efficient offshore structure which can be used in areas subjected to strong seismic activity. The present invention satisfies this need.

SUMMARY OF THE INVENTION

The present invention is directed to a new concept, the Earthquake-Compliant Jacket (ECJ), having a configuration which effectively "tunes" the structure to avoid the majority of both storm wave and earthquake energy. In one embodiment, the invention is an earthquake-compliant offshore platform jacket structure for use in an earthquake-prone body of water, comprising: a substantially vertical space-frame structure extending upwardly from the floor of the body of water to a point located above the surface of the body of water; foundation means for attaching the space-frame structure to the floor of the body of water; and a deck structure attached to the upper end of the space-frame structure. The space-frame structure, the foundation means, and the deck structure are designed such that the natural vibrational period of the space-frame structure is greater than the primary excitation period of earthquake energy and less than the primary wave period of storm energy in the body of water. Preferably, the space-frame structure is substantially vertical and has a substantially uniform horizontal cross section. In a preferred embodiment, the space frame structure has a square cross section. The foundation means, in a preferred embodiment, comprises a plurality of skirt piles, attached to the lower end of the substantially vertical space-frame structure, which extend downwardly into the floor of the body of water. The natural vibrational period of the space-frame structure is preferably between about 4 seconds and about 8 seconds.

BRIEF DESCRIPTION OF THE DRAWINGS

For a better understanding of the present invention, reference may be made to the accompanying drawings, in which:

FIG. 1 also shows the typical natural vibrational periods for both a SPJ and an ECJ.

The invention will be described in connection with its preferred embodiments. However, to the extent that the following detailed description is specific to a particular embodiment or a particular use of the invention, this is intended to be illustrative only, and is not to be construed as limiting the scope of the invention. On the contrary, it is in tended to cover all alternatives, modifications, and equivalents which may be included within the spirit and scope of the invention, as defined by the appended claims.

DETAILED DESCRIPTION OF THE INVENTION

Figure 2:
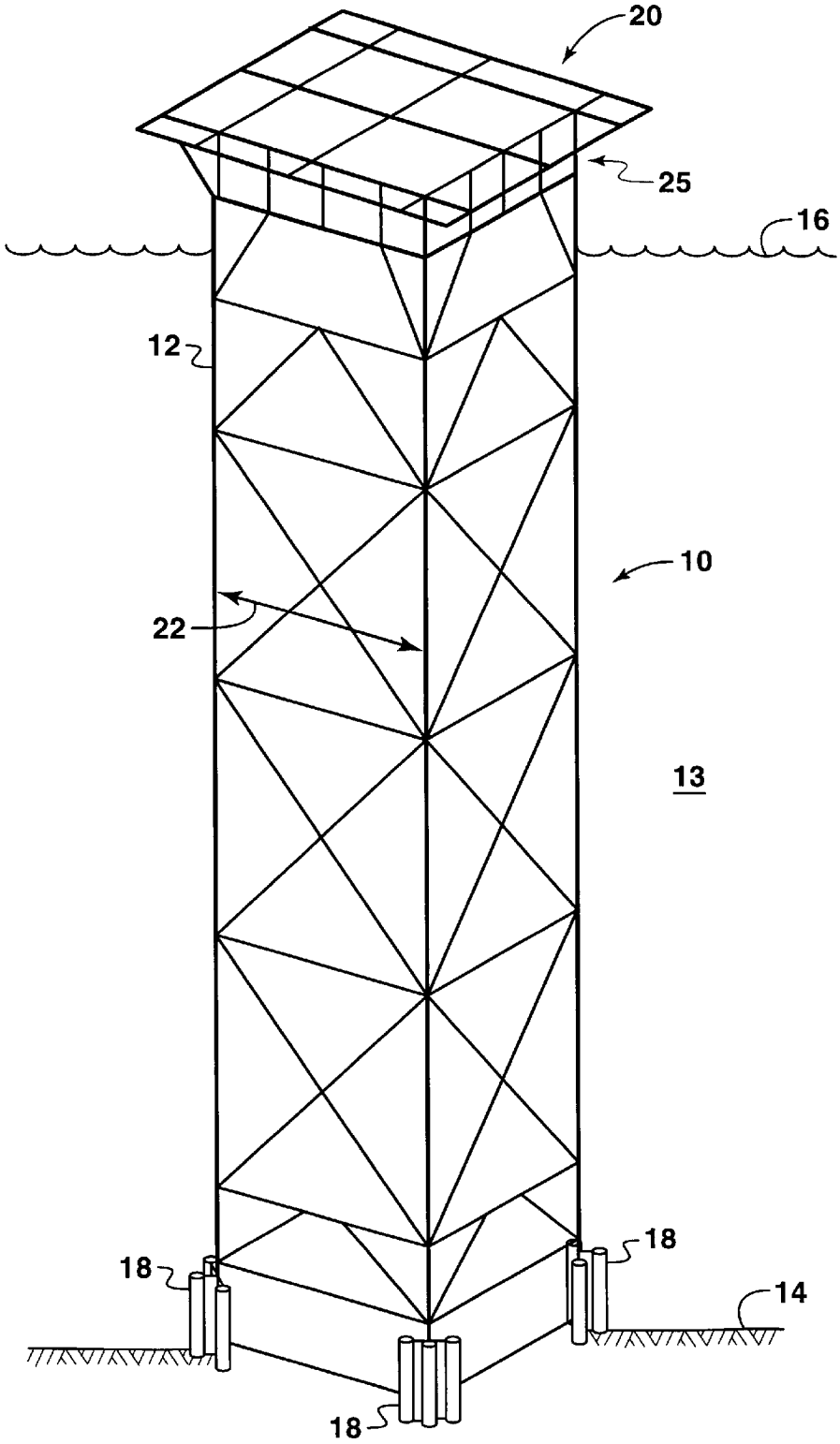
FIG. 2 is a perspective view of one embodiment of an ECJ according to the present invention.
Figure 3:
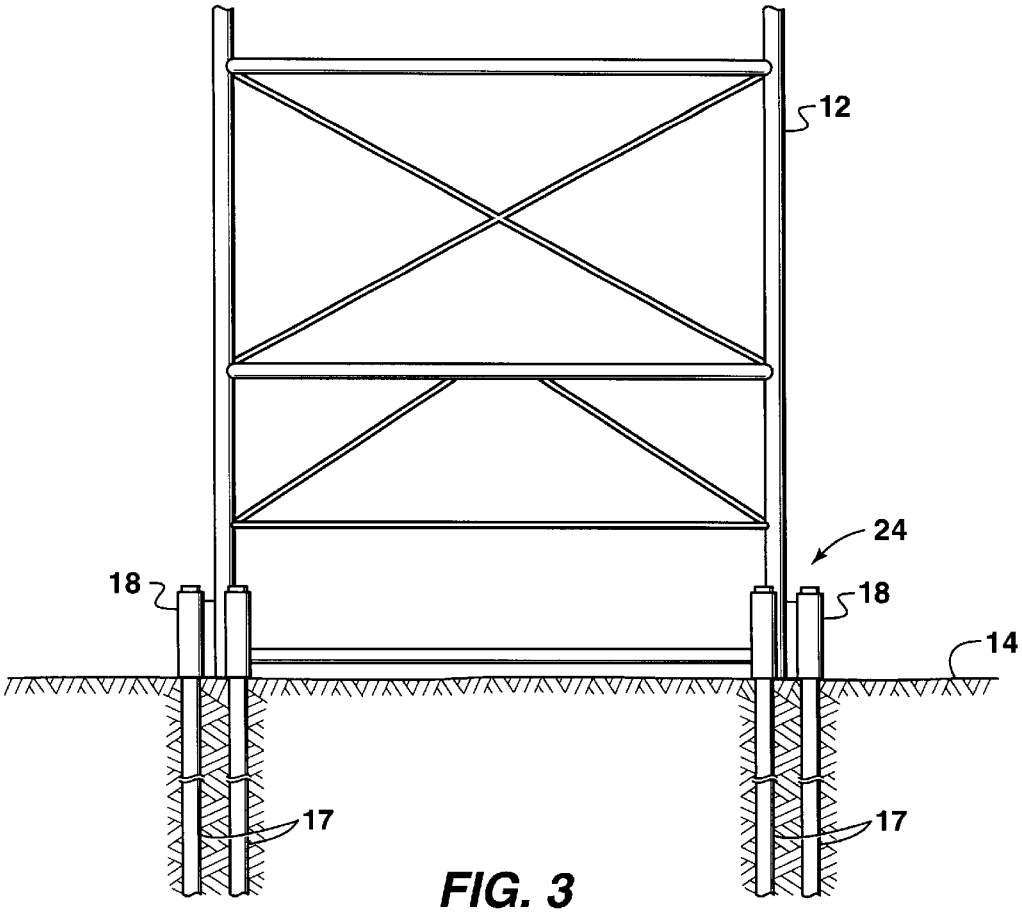
FIG. 3 is an elevational view of a skirt pile foundation for use in connection with the present invention.
Figure 4:
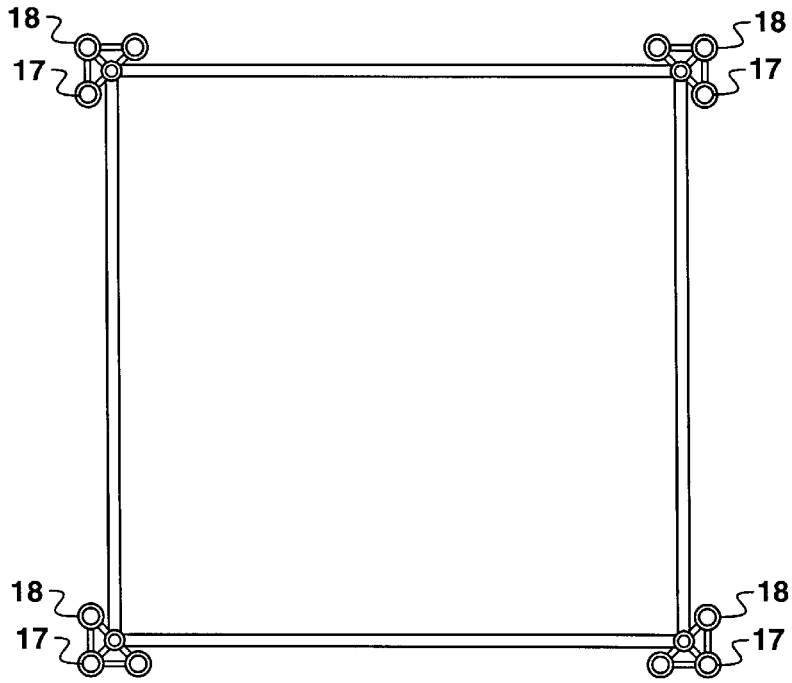
FIG. 4 is a plan view of the skirt pile foundation of FIG. 3.

Referring to FIG. 2, the ECJ offshore platform jacket structure 10 is a bottom founded, non-battered space-frame jacket structure 12 which transmits shear and overturning forces into the platform's foundation. The earthquake-compliant offshore platform jacket structure 10 for use in an earthquake-prone body of water 13, comprises a substantially vertical space-frame structure 12 extending upwardly from the floor 14 (see FIG. 3) of the body of water 13 to a point located above the surface 16 of the body of water 13. Foundation means are used to attach the space-frame structure 12 to the floor 14 (see FIG. 3) of the body of water 13. In a preferred embodiment, the foundation means comprises a plurality of skirt piles 17 (see FIG. 3 and FIG. 4) attached to the lower end 24 of the substantially vertical space-frame structure 12, which extend downwardly into the floor 14 of the body of water 13. The skirt piles 17 may be attached to the space-frame structure 12 in any conventional manner such as, for example, by driving them through sleeves 18 attached to the space-frame structure 12 and grouting them therein. In a preferred embodiment (see FIG. 4), at each corner of the space-frame structure 12 are three skirt piles 17. Skirt piles 17 are the preferred embodiment for the foundation means because skirt piles 17 can be driven to grade without interruption using an underwater hammer, thus reducing installation time and cost. However, other conventional foundation means such as surface-driven main piles (for which driving has to be stopped while the piles are made-up) may be used. The foundation means may comprise a combination of skirt and main piles. The main piles may be attached anywhere between the upper end 25 and the lower end 24 of the space-frame structure 12, and the piles may be attached inside the jacket legs or outside the jacket legs using a means of connection such as pile sleeves. A deck structure 20, which can be modular or integrated, is attached to the upper end 25 of the space-frame structure 12.

The space-frame structure 12, the foundation means, and the deck structure 20 are designed such that the natural vibrational period of the space-frame structure 12 is greater than the primary excitation period of earthquake energy and less than the primary wave period of storm energy in the body of water 13. The substantially vertical space-frame structure 12 has a substantially uniform horizontal cross section, and in a preferred embodiment has a square cross section (i.e., each side has a uniform width 22). Preferably, the natural vibrational period of the space-frame structure 12 is between about 4 seconds and about 8 seconds.

Figure 1:
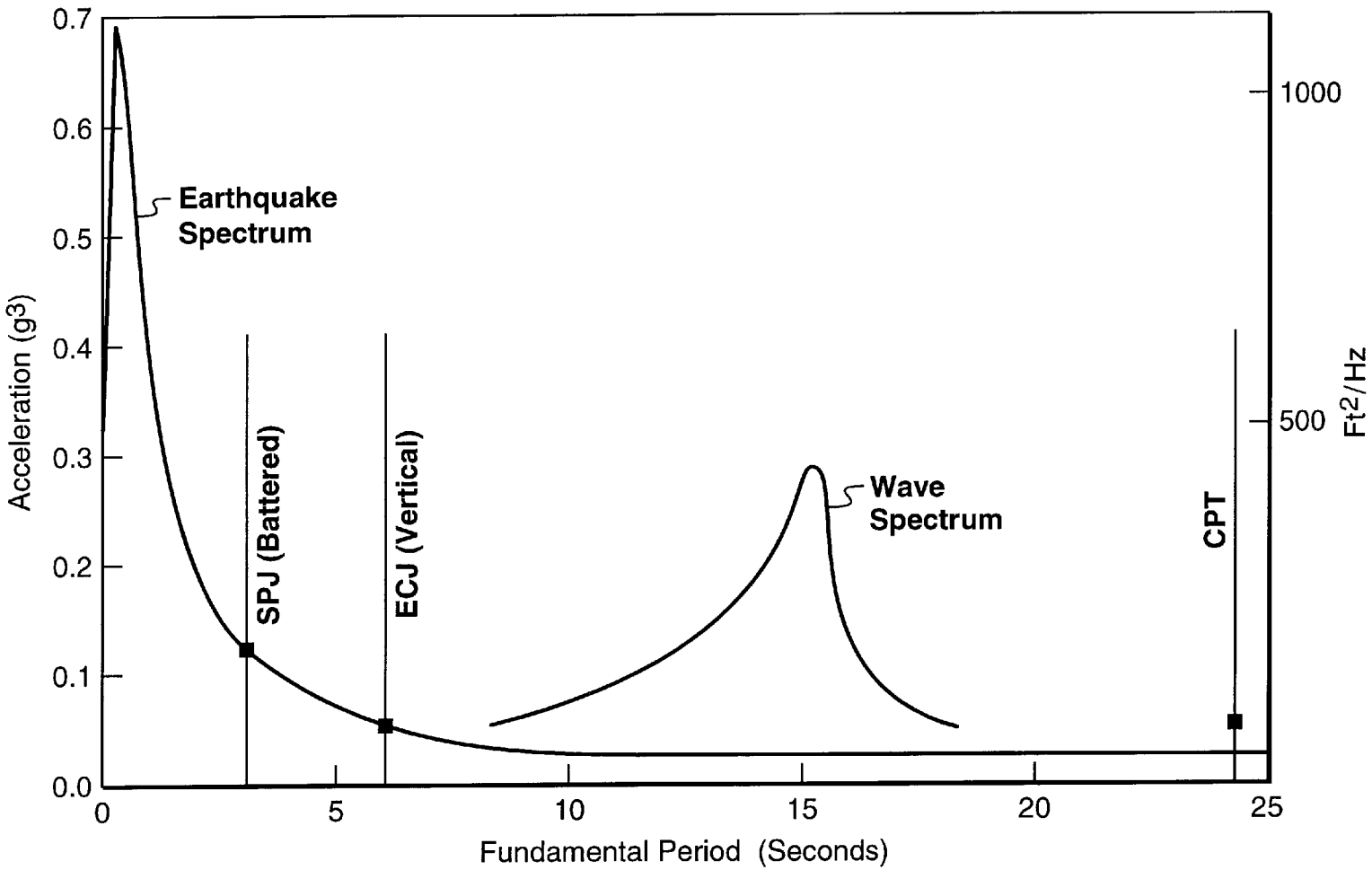
FIG. 1 is a graph illustrating earthquake and wave spectra relationships to structural fundamental periods.

As discussed previously, in areas where earthquake loads are strong, the resulting structure tends to be a relatively heavy, inefficient SPJ. However, if the natural period of an SPJ could be increased, moving away from the energy of the strong earthquakes, the structure would attract considerably less seismic load. The ECJ offshore platform jacket structure 10 of the present invention achieves this goal by modifying the cross-section to create a more flexible structure. As shown in FIG. 1, an ECJ structure 10 will have a fundamental period between the primary energy of both seismic and wave spectra. This shift from the SPJs fundamental period moves the ECJ structure's natural period several seconds closer to the wave energy's period. In areas where the wave energy is only moderate, the increased wave load has little impact. The result is that in regions of strong earthquake and moderate waves, the ECJ structure 10 is considerably lighter than conventional SPJs. In areas of increased wave energy, the ECJ structural weight savings will decrease. The optimum ECJ solution is a structure "tuned" between the two spectra.

It should be noted that the ECJ structure 10 will likely have an increased space-frame structure 12 fatigue over that of a conventional SPJ; nevertheless, fatigue can be accommodated in the design process without significant weight increase. Fatigue is a concern with the ECJ structure 10 because of its compliant response to waves. Because the natural period of an ECJ structure 10 is closer to the periods of the large waves, the joints of such a structure 10 will experience larger and more frequent cyclic loadings. The effect of these more frequent and larger stress cycles can be countered by increased joint can wall thickness, and/or weld profiling, or by other conventional means without significant weight increase to the structure 10.

As can be seen from the following example, it is anticipated that an ECJ structure 10 will reflect a 10 to 15 percent reduction in steel weight of the jacket 12 and piles 17 over a comparable conventional SPJ design for the functional requirements of a particular application. These weights can be further reduced by increasing the natural period of the ECJ structure 10, which could be accomplished by changing cross-section dimensions or with additional topside load, either functional or non-functional. In addition to weight savings, the ECJ offers the advantage of easier and more economical construction because of its constant cross-section 22 which can result from the ECJ structure's simpler, right-angle, joint construction and reduced working heights. Additionally, the ECJ structure's conceptual design should take into account extreme wave, earthquake, launch and tow analysis for the space-frame structure 12 and extreme wave and earthquake analysis for the deck structure 20. Conventional methods and design tools will be known to those skilled in the art. The following example further illustrates the inventive ECJ concept.

EXAMPLE

The following is an example of the design of an ECJ structure 10 in approximately 400 feet of water for a moderate wave (significant wave height of 29.8 ft.) and highly seismic active area (zero period ground acceleration of 0.21% g). The ECJ structure 10 of this example supports 32 well slots and an 11,000 short ton (ST) topsides comprised of a single drill rig, storage, living quarters, helideck, and other miscellaneous items. The ECJ structure 10 features a 92 ft×92 ft constant cross-section and twelve 84 inch skirt piles 17. The modular deck structure 20 measures approximately 135 ft×135 ft at the drilling deck and 92 ft×92 ft at the cellar deck. Resulting weights are summarized below:

| Component | Weight |
|---|---|
| Jacket 12 | 5,400 ST (4,900 MT) |
| Piles 17 | 3,800 ST (3,450 MT) |
| Conductors | 3,400 ST (3,090 MT) |
| Deck 20 | 2,300 ST (2,090 MT) |

These weights reflect a 10 to 15 percent reduction in steel weight of the ECJ space-frame structure 12 and piles 17 over a comparable conventional SPJ design for the given functional requirements. However, these weights can be further reduced by increasing the natural period of the ECJ structure 10. This could be accomplished by changing cross-section dimensions or with additional topside load, either functional or non-functional. In addition to weight savings, the ECJ structure 10 offers the advantage of easier and more economical construction because of its constant cross-section. This results in simpler joint construction and reduced working heights.

The study example evaluated the ECJ structure 10 under extreme wave, seismic, launch and tow conditions. Other loading conditions, such as loadout, on-bottom stability, and fatigue, should be considered; however, none of these issues are believed to have impact on concept viability. The weights set forth in this example are not expected to vary significantly as the above loading conditions are investigated and resolved.

The topsides are comprised of the following components: drill rig, storage, living quarters, helideck, cranes, bridge, caissons, and miscellaneous (buildings, etc.). These items, coupled with the deck structure 20 structural steel amount to 11,000 ST. The example design called for 32 well slots, no risers and a field life of 30 years. The ECJ structure 10 was designed to satisfy API RP2A "Recommended Practices for Planning, Designing and Constructing Fixed Offshore Platforms—Working Stress Design"—20th Edition, and applicable American Institute of Steel Construction guidelines. The ECJ structure 10 could have also been designed using LRFD; in fact, since the structure may be considered a gravity load dominated structure, the smaller dead load safety factors may have resulted in lower jacket weights. The platform foundation design criteria satisfied API RP2A guidelines.

As previously mentioned, fatigue should be reviewed with the ECJ structure 10 because of its compliant response to waves. The natural period of these ECJ structures 10 is closer to the periods of the large waves and consequently their joints will experience larger and more frequent cyclic loadings. The effect of these more frequent and larger stress cycles can be countered by increased joint can wall thickness and/or weld profiling. To account for the impact of fatigue on the ECJs, large (conservative) estimates of joint can weights were included in the example analyses. The result, even with increased joint weights, is that in the environment described above, the example ECJ structure 10 is considerably lighter than conventional SPJs.

Environmental design criteria analyzed included earthquake and oceanographic criteria. The earthquake design criteria reflected the 500 year return period earthquake. The 500 year return period earthquake was based on a response spectrum with zero period ground acceleration of 0.21% g. The spectra did not define motions beyond 4 seconds; it was assumed that the acceleration at and beyond 4 seconds was constant. This approach follows the practices and provisions set forth in API-RP2A. The oceanographic design criteria provide for waves, current, tides and winds which may occur during the expected life of the structure. Marine growth may also need to be considered.

The strength of steel needed for the example ECJ space-frame structure 12 ranges from 30 to 50 ksi. Jacket legs and piles 17 are 50 ksi and remaining jacket members are 36 ksi. Deck plate girders are 50 ksi and deck beams, plating, and finishing steel are 36 ksi. All joint cans assume a higher class of 50 ksi steel. Conventional steels known to those skilled in the art may be used. In final selection of steels, consideration should be given to necessary toughness characteristics suitable for the conditions of service.

The space-frame structure 12 has a constant cross-section (no batter) of 92 ft.×92 ft. with a natural period of around 4.6 seconds. The width 22 was driven by the available fabrication yard skidways. A modular deck structure 20 measures approximately 135 ft×135 ft at the drilling deck and 92 ft×92 ft at the cellar deck. The module support frame (MSF) is connected to the space-frame structure 20 jacket at elevation (+) 16 ft. Modules are designed to provide enough space and load carrying capability for drilling, quarters, storage, and miscellaneous operational weights. The various conventional appurtenances (conventional pile guides, diagonals, pile sleeves, hydrostatic rings, deck plating) associated with the ECJ structure 10 were modeled to account for their inertia and wave loading on the space-frame structure 12.

Table 1 summarizes some of the key features of the ECJ structure 10, including the steel weights for the space-frame structure 12, skirt piles 17, conductors, and deck structure 20. Note that the first period of the ECJ structure 10 has been increased to about 4.6 seconds compared to around 3 seconds for a conventional SPJ of similar functional requirements. This modest increase results in a reduction in jacket base shear due to approximately 4,700 kips. The base shear from the design wave is only 2,100 kips. If the natural vibrational period of the ECJ structure 10 were optimally "tuned", these two values would be considerably closer. The difference suggests that increasing the space-frame structure 12 period could result in some additional benefit.

The natural vibrational period of a structure is a function of both the structural stiffness and mass. Adjusting the stiffness for this example will be difficult given the fixed skidway dimension has constrained the space-frame structure 12 dimensions to 92 ft by 92 ft. However, changing the cross-section dimensions of the space-frame structure 12 would be possible for other construction sites. Adjusting the mass requires changing the topside weight and/or increasing the inertial mass of the system with "mass traps" (i.e., such as enclosing some portion of the upper part of the space-frame structure 12 with a perimeter wall). However, mass traps often result in inordinately increased wave loads and are expensive to fabricate. If the topsides weight could be increased, the resulting mass would increase the ECJ structure's 10 natural period and could lead to a further reduction in earthquake base shear. Such a reduction could also lead to a reduction in the already improved structural weight. The additional deck structure 20 weight could be functional or non-functional.

TABLE 1

Key Features of the Example ECJ Structure 10

| Parameter | Unit | Value |
|---|---|---|
| Water depth | ft. | 400 |
| No. of well slots | # | 32 |
| Topside weight | ST | 11,000 |
| Base dimensions | ft. × ft. | 92 × 92 |
| Top dimensions | ft. × ft. | 92 × 92 |
| No. and diameter of skirt piles | #in. | 12–84 |
| Skirt pile penetration | ft. | 300 |
| First period | s | 4.7/4.4 |
| Second period | s | 1.4/1.2 |
| Earthquake response | | |
| Acceleration at 1 s (zero period ground) | g | 0.21 |
| Base shear | kips | 4,700 |
| Pile reaction | kips | 4,700 |
| Storm response | | |
| Significant wave height | ft. | 29.8 |
| Base shear | kips | 2,100 |
| Pile reaction | kips | 4,800 |
| Tower weights | | |
| Jacket (12) | ST | 5,400 |
| Piles1 (17) | ST | 3,800 |
| Conductors2 | ST | 3,400 |
| Deck (20) | ST | 2,300 |

Footnotes:
[1]Assumes a pile thickness of 2 inches. Pile drivability analysis is needed to confirm thickness.
[2]Assumes a conductor penetration of 200 ft.

Results of this example study are compared with an SPJ design in Table 2. The estimate of a conventional SPJ for the Gulf of Mexico utilizes a proprietary cost estimating and planning program. The SPJ design has an 11,000 ST topsides and 32 well slots which is the same as the ECJ example. Of course, there is little seismic activity in the Gulf, so the SPJ weights do not explicitly account for earthquakes. However, experience with SPJ designs in the hurricane dominated Gulf of Mexico and in the earthquake controlled example area suggests that the resulting structural weights for a given set of functional requirements in these two environments are similar. Therefore, the Gulf of Mexico SPJ has been included for comparison purposes.

TABLE 2

Weight Comparisons: SPJ Design and ECJ Design

| Parameter | Unit | SPJ | Example ECJ |
|---|---|---|---|
| Water depth | ft | 400 | 400 |
| No. of well slots | # | 32 | 32 |
| Topside weight | ST | 11,000 | 11,000 |
| Tower weights | | | |
| Jacket (12) | ST | 6,300 | 5,400 |
| Piles1 (17) | ST | 4,200 | 3,800 |
| Conductors2 | ST | 3,400 | 3,400 |
| Deck (20) | ST | 2,300 | 2,300 |

Footnotes:
[1]Assumes a pile thickness of 2 inches. Pile drivability analysis is needed to confirm thickness.
[2]Assumes a conductor penetration of 200 ft.

Based on the SPJ and ECJ cases presented in Table 2 and the foregoing detailed description of the invention, it is concluded that the ECJ structure 10, without any additional refinement, can save approximately 10 to 15 percent of the vertical space-frame structure 12 and pile 17 weights over estimates of a conventional SPJ with similar functional requirements. The current ECJ space frame-structure 12 has the potential to be further tuned, for example, by adding functional or non-functional weight to the deck 20, in order to reduce steel tonnages. In addition to weight savings, the ECJ space-frame structure 12 offers the advantage of easier and more economical construction because of its constant cross-section. Appreciable cost savings are likely to result from the ECJ space-frame structure's simpler joint construction and reduced working heights.

It should be understood that the foregoing description is illustrative and that other embodiments of the invention can be employed without departing from the full scope of the invention as set forth in the appended claims.

We claim:

1. An earthquake-compliant offshore platform jacket structure for use in an earthquake-prone body of water, comprising:

a substantially vertical space-frame structure having a substantially uniform horizontal cross section extending upwardly from the floor of the body of water to a point located above the surface of the body of water;

foundation means for attaching said space-frame structure to the floor of said body of water; and a deck structure attached to the upper end of said space-frame structure;

said space frame structure, including the effects of the foundation means and the deck structure, having a primary natural vibrational period greater than the primary excitation period of earthquake energy and less than the primary wave period of storm energy in said body of water.

2. The earthquake-compliant offshore platform jacket structure of claim 1, wherein said substantially uniform horizontal cross section is a square cross section.

3. The earthquake-compliant offshore platform jacket structure of claim 1, wherein said foundation means comprises a plurality of skirt piles attached to the lower end of said substantially vertical space-frame structure and extending downwardly into the floor of said body of water.

4. The earthquake-compliant offshore platform jacket structure of claim 1, wherein said foundation means comprises a plurality of piles attached at any point along the length of said substantially vertical space frame structure and extending downwardly into the floor of said body of water.

5. The earthquake-compliant offshore platform jacket structure of claim 1, wherein said primary natural vibrational period of said space-frame structure is between about 4 seconds and about 8 seconds.

6. An earthquake-compliant offshore platform jacket structure for use in an earthquake-prone body of water, comprising:

a substantially vertical space-frame structure having a substantially uniform horizontal cross section extending upwardly from the floor of the body of water to a point located above the surface of the body of water;

foundation means for attaching said space-frame structure to the floor of said body of water; and a deck structure attached to the upper end of said space-frame structure;

said space frame structure, including the effects of the foundation means and the deck structure, having a primary natural vibrational period between about 4 seconds and about 8 seconds in said body of water.

7. The earthquake-compliant offshore platform jacket structure of claim 6, wherein said substantially uniform horizontal cross section is a square cross section.

8. The earthquake-compliant offshore platform jacket structure of claim 6, wherein said foundation means comprises a plurality of skirt piles attached to the lower end of said substantially vertical space-frame structure and extending downwardly into the floor of said body of water.

9. The earthquake-compliant offshore platform jacket structure of claim 6, wherein said foundation means comprises a plurality of piles attached at any point along the length of said substantially vertical space frame structure and extending downwardly into the floor of said body of water.

10. An earthquake-compliant offshore platform jacket structure for use in an earthquake-prone body of water, comprising:

a substantially vertical space-frame structure having a substantially uniform horizontal cross section extending upwardly from the floor of the body of water to a point located above the surface of the body of water; foundation means for attaching said space-frame structure to the floor of said body of water; and a deck structure attached to the upper end of said space-frame structure;

said earthquake compliant offshore platform jacket structure having a primary natural vibrational period greater than the primary excitation period of earthquake energy and less than the primary wave period of storm energy in said body of water.

11. The earthquake-compliant offshore platform jacket structure of claim 10, wherein said substantially uniform horizontal cross section is a square cross section.

12. The earthquake-compliant offshore platform jacket structure of claim 10, wherein said foundation means comprises a plurality of skirt piles attached to the lower end of said substantially vertical space-frame structure and extending downwardly into the floor of said body of water.

13. The earthquake-compliant offshore platform jacket structure of claim 10, wherein said foundation means comprises a plurality of piles attached at any point along the length of said substantially vertical space frame structure and extending downwardly into the floor of said body of water.

14. The earthquake-compliant offshore platform jacket structure of claim 10 having a primary natural vibrational period between about 4 seconds and about 8 seconds.

15. An earthquake-compliant offshore platform jacket structure for use in an earthquake-prone body of water, comprising:

a substantially vertical space-frame structure having a substantially uniform horizontal cross section extending upwardly from the floor of the body of water to a point located above the surface of the body of water;

foundation means for attaching said space-frame structure to the floor of said body of water; and a deck structure attached to the upper end of said space-frame structure;

said earthquake compliant offshore platform jacket structure having a primary natural vibrational period between about 4 seconds and about 8 seconds in said body of water.

16. The earthquake-compliant offshore platform jacket structure of claim 15, wherein said substantially uniform horizontal cross section is a square cross section.

17. The earthquake-compliant offshore platform jacket structure of claim 15, wherein said foundation means comprises a plurality of skirt piles attached to the lower end of said substantially vertical space-frame structure and extending downwardly into the floor of said body of water.

18. The earthquake-compliant offshore platform jacket structure of claim 15, wherein said foundation means comprises a plurality of piles attached at any point along the length of said substantially vertical space frame structure and extending downwardly into the floor of said body of water.

* * * * *